US005514392A

United States Patent [19]

Garwood

[11] Patent Number: 5,514,392

[45] Date of Patent: May 7, 1996

[54] PACKAGING FOR PERISHABLE GOODS

[75] Inventor: Anthony J. M. Garwood, Hawthorn, Australia

[73] Assignee: Seawell Corporation N.V., Curacao, Netherlands Antilles

[21] Appl. No.: 265,933

[22] Filed: Jun. 27, 1994

Related U.S. Application Data

[63] Continuation of Ser. No. 136,879, Oct. 18, 1993, abandoned, which is a continuation of Ser. No. 835,977, Feb. 27, 1992, abandoned.

[30] Foreign Application Priority Data

Aug. 30, 1989 [AU] Australia ..... PJ6039
Mar. 27, 1990 [AU] Australia ..... PJ9326

[51] Int. Cl.[6] ..... B65B 31/04; B65D 81/20

[52] U.S. Cl. ..... 426/106; 53/284.5; 53/329.4; 53/329.5; 53/433; 53/467; 53/473; 53/477; 53/485; 53/488; 53/511; 206/213.1; 426/129; 426/396; 426/411; 426/413

[58] Field of Search ..... 426/106, 129, 426/263, 392, 396, 411, 413; 53/284.5, 329.4, 329.5, 432, 433, 467, 473, 477, 485, 488, 510, 511; 206/213.1

[56] References Cited

U.S. PATENT DOCUMENTS 4,061,785 12/1977 Nishino et al. ..... 426/106 X
4,840,271 6/1989 Garwood ..... 206/213.1

FOREIGN PATENT DOCUMENTS

WO 87/02965 5/1987 WIPO .
WO 88/00970 2/1988 WIPO .

*Primary Examiner*—Leo B. Tentoni
*Attorney, Agent, or Firm*—Foley & Lardner

[57] ABSTRACT

Improved packaging for perishable goods such as meats comprising a base over which the goods are placed, and a lid positioned over the top of its base and sealed to said base. Strands are placed over the goods for holding said goods relative to the packaging, with a space above the goods and under the lid. A gas is introduced in the space for enhancing preservation of the packaging goods by contacting the surface of the goods. The gas contacts the goods by passing through the strands, with the strands being of a size permitting viewing of a major portion of an upper surface of the goods. The invention further includes the method of and apparatus for producing the packaging.

32 Claims, 5 Drawing Sheets

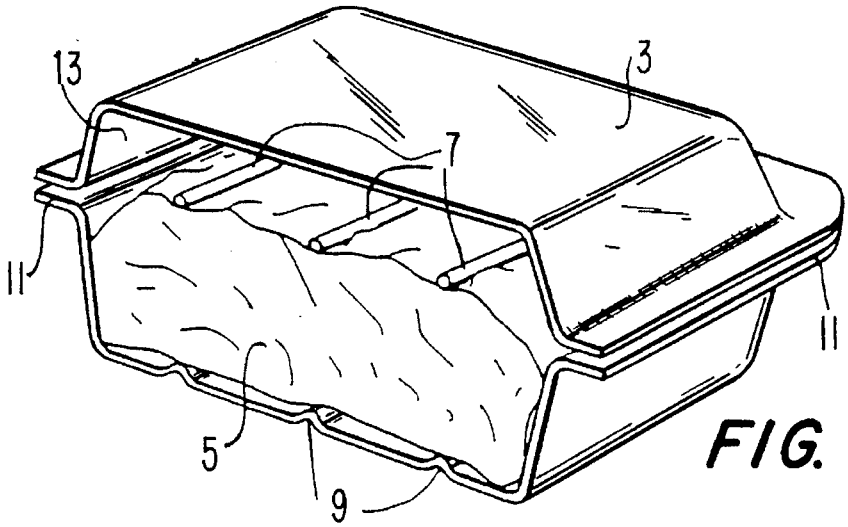
FIG. 3
FIG. 4
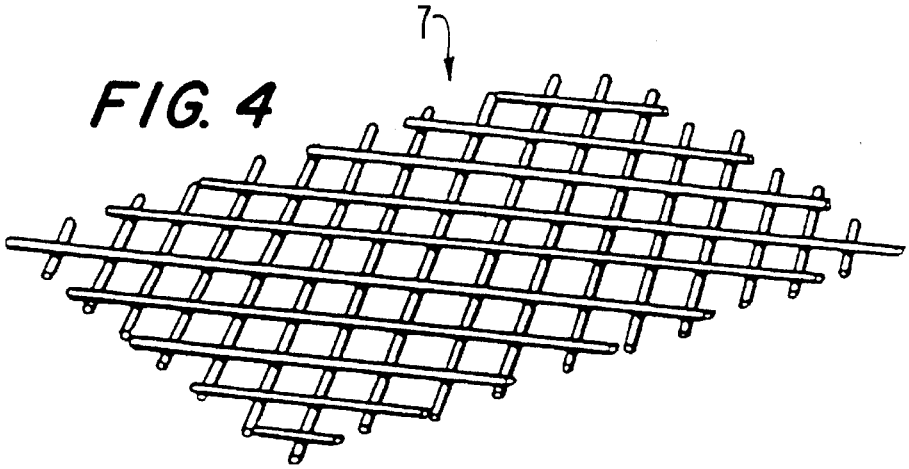
FIG. 6
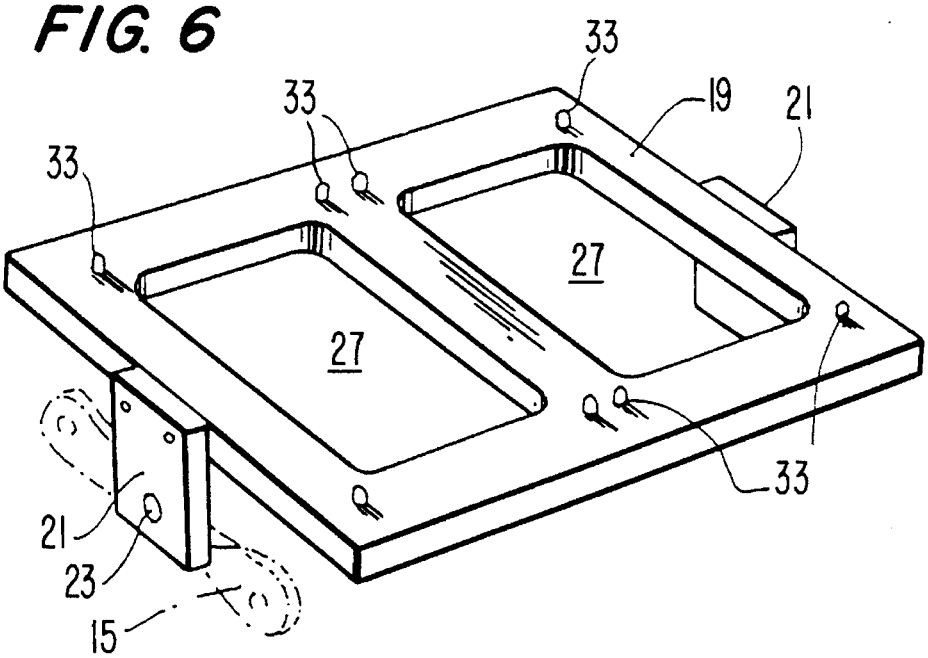

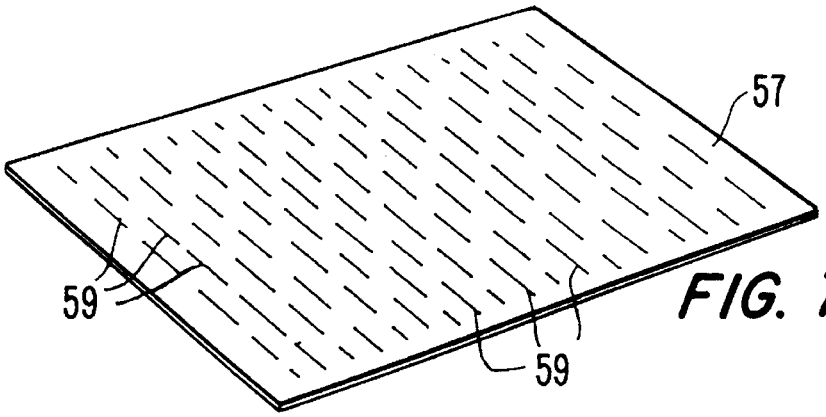
FIG. 7a
FIG. 7b
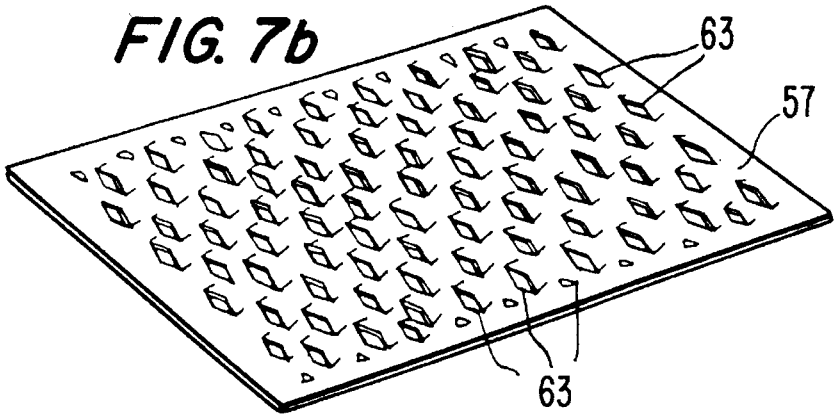
FIG. 8
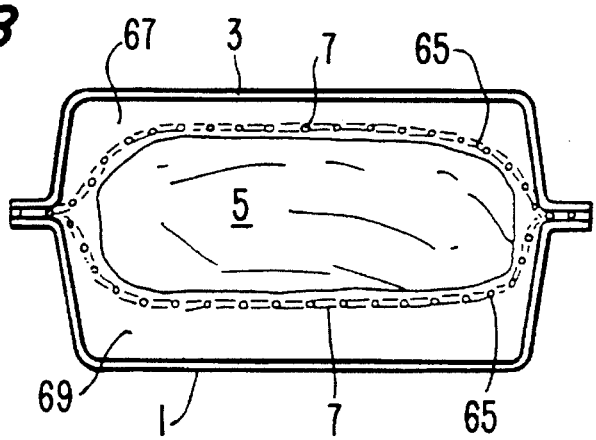
FIG. 9
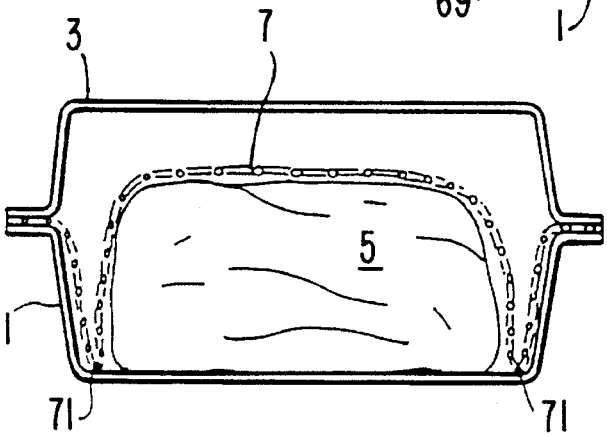

PACKAGING FOR PERISHABLE GOODS

This application is a continuation of application Ser. No. 08/136,879, filed Oct. 18, 1993, now abandoned, which is in turn a continuation of application Ser. No. 07/835,977, filed Feb. 27, 1992, now abandoned, which is a National Stage of PCT/AU90/00382.

FIELD OF THE INVENTION

This invention relates to improved packaging for perishable goods and relates particularly but not exclusively to improved packaging for meats such as red meats.

DESCRIPTION OF PRIOR ART

Hitherto, there have been many proposals for packaging goods in a clear plastics material. With meats and other perishable type goods, the shelf life is limited because of the growth of bacteria within the packaging and because of discoloration of the packaged goods, particularly red meats. It has been known to provide certain gases within the package to enhance the keeping properties of the packaged goods. In the case of meats, a combination of $O_2$ and $CO_2$ is used. Generally, the volume of gas is equal to the volume of the meat. Typically $O_2$ is present in the proportion of 80% while the $CO_2$ is present in the proportion of 20% in red meats.

Examples of known packaging for this purpose are disclosed in PCT Patent Application PCT/AU86/00339, PCT/AU87/00243, PCT/AU87/00297 and PCT/AU88/00424 all in the name Garwood Limited. The subject matters of the above applications are hereby incorporated by reference.

It is considered that the construction of the packaging in the aforementioned patent specifications is unnecessarily expensive and that the resulting equipment which is required to manufacture the packaging is also unnecessarily expensive. The packaging is considered to be unnecessarily expensive because of the requirement to provide for multi-layered webs of plastics material for the base and for the lid and for the skin wrapping membrane. Multi-layered webs are required in order to provide for the required gas permeability and/or non-permeability while at the same time allowing sealing of the various packaging components together. The machines used for producing the above packaging are considered unnecessarily expensive because, as an example, complicated drive arrangements are required to advance all the webs of plastic material at a controlled rate so that one or more webs will not rupture prior to sealing of the package.

The packaging in the above patent applications relates generally to providing a clear plastics base, goods positioned within the base, a plastics material skin wrapping the goods relative to the base, a lid sealed over the base, and a space under the lid above the skin wrapping material. A gas is retained within the space for enhancing the keeping properties of the packaged goods. The skin wrapping material is gas permeable so that the gas can pass through the skin wrapping material and contact the goods. Additionally, gases which may generate or exude from the packaged goods can, in some cases, pass through the skin wrapping web and into the space.

The skin wrapping material is used to physically support and hold the goods relative to the base so they do not flop around within the package.

It has been realized that improved packaging can be obtained without the use of a skin wrapping web, but instead where strand means are used to hold the goods relative to the packaging. The strand means may comprise individual filaments which extend across the upper surface of the goods or may comprise a mesh which is held over the top of the goods. Alternatively, the strand means may comprise a web of plastics material which as been slit and stretched so that it represents an expanded mesh arrangement where the remaining portions of the web material between the slits form strand means.

The strand means are of a size which will permit easy viewing of the upper surface of the packaged goods without obstructing direct viewing of a major portion of the upper surface of the goods. The strand means also does not significantly interfere with the gas contacting the surface of the packaged goods. The strand means is such that it is stronger than the skin wrapping webs and hence complicated feeding means for permitting the strand means to be correctly placed within the packaging as needed for the skin wrapping webs is not required. This contrasts significantly with the feed means in packaging machines used for the packaging in the aforementioned patent specifications, where the stretch skin wrapping web has to be controlled precisely thereby so that it will not rupture or buckle or fold.

OBJECT AND STATEMENT OF INVENTION

Accordingly it is an object of the present invention to provide an improved packaging, a method of production and apparatus therefor.

Therefore, in accordance with a first broad aspect of the present invention there may be provided improved packaging for perishable goods comprising:

a base over which said goods are placed, strand means over said goods holding said goods relative to said packaging, a lid positioned over the top of said base and sealed to said base, a space above said goods and under said lid, a gas in said space, said gas selected for enhancing preservation of the packaging goods by contacting the surface of said goods, said strand means not substantially inhibiting said gas from contacting said goods and permitting viewing of a major portion of the upper surface of said goods.

In this way, the strand means will hold the goods relative to the packaging such as the base, and if the packaging base and lid are of a clear plastics material, then substantially the whole of the surface of the packaged goods can be inspected by an intending purchaser. Thus, the packaging will be pleasing to an intending purchaser.

BRIEF DESCRIPTION OF DRAWINGS

In order that the invention can be more clearly ascertained, preferred embodiments will now be described with reference to the accompanying drawings, wherein:

FIG. 3 is a part sectional perspective view of the packaging shown in FIGS. 1 and 2, showing how strand means engage with the upper surface of the packaged goods. The packaging of FIG. 3 is shown just prior to the lid and the base being sealed together;

FIG. 4 shows strand means in the form of a mesh;

FIG. 6 is a perspective view of a preferred plate means for use with the packaging machine of FIG. 5;

FIGS. 7*a* and 7*b* show a form of web material which is slitted and subsequently expanded to provide strand means;

FIG. 8 is a side cross-sectional view of a further embodiment of packaging;

FIG. 9 is a side view of a further embodiment of packaging;

DETAILED DESCRIPTION OF PREFERRED EMBODIMENTS

Figure 1:
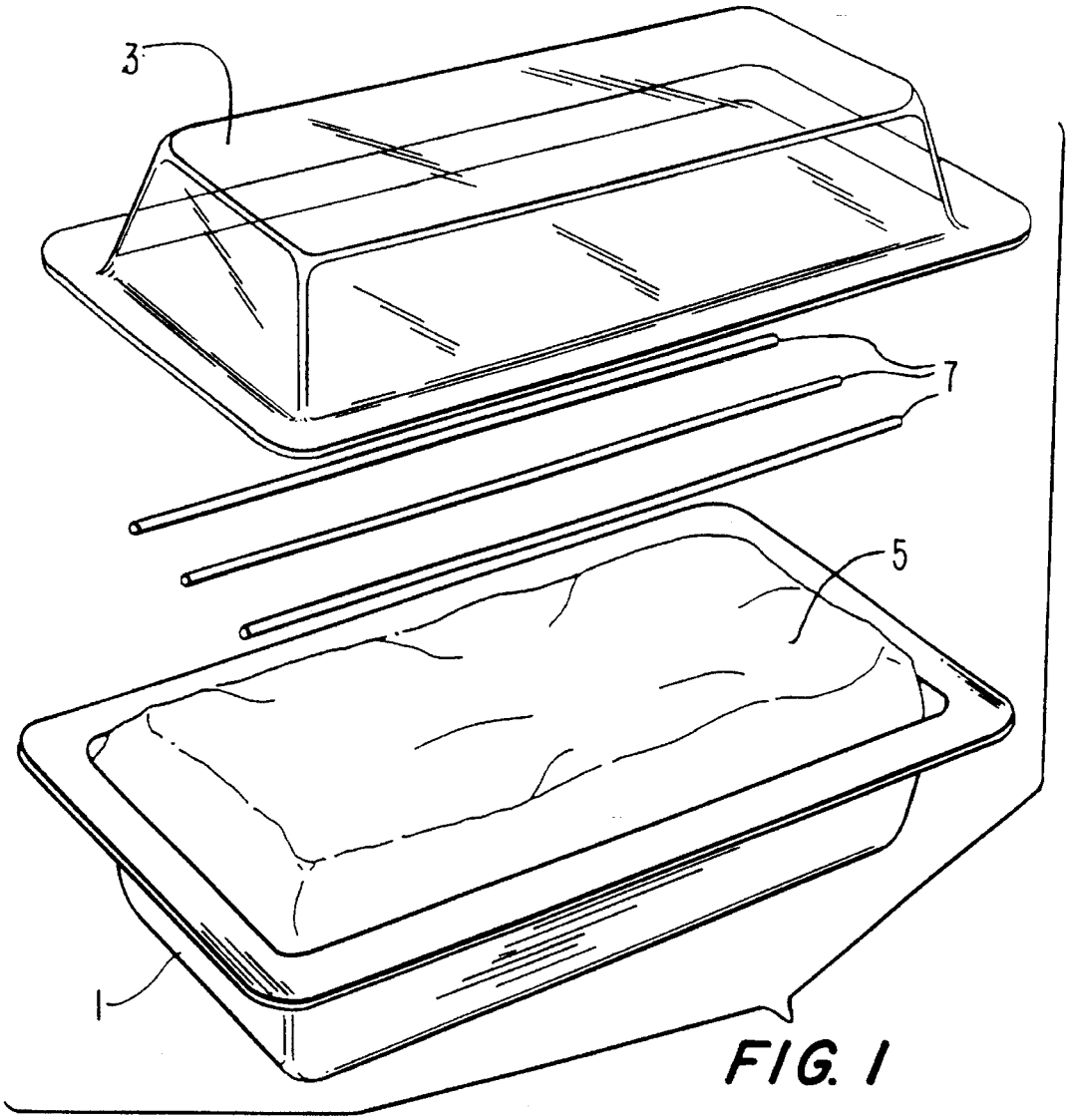
FIG. 1 is an exploded perspective view of one preferred packaging.

Referring now to FIG. 1, there is shown improved packaging for packaging perishable food stuffs and in this embodiment red meats. The packaging comprises a base 1 and a lid 3. In the embodiment shown, each of the base 1 and lid 3 is of shallow tray-like configuration. The lid and the base are both made from PVC which may have a polyethylene coating on the inside faces. The PVC is therefore a substantially gas impervious gas barrier material. The polyethylene coating may be treated with an anti-fogging agent or material. Typically the lid has the PVC of 200 um thickness and the polyethylene coating of 80 um thickness. Typical size ranges for the lid materials could be for the PVC, 100 to 400 um thickness and for the polyethylene coating, 20 to 200 um thickness. The base 1 has the PVC of about 400 um with a polyethylene coating of about 80 um thickness. Typical ranges for the PVC in the base 1 are 200 um to 800 um and for the polyethylene coating 50 um to 100 um. Thicknesses outside these limits are possible but the above appears to represent desirable thickness ranges. The base 1 is shaped and sized to neatly receive goods 5 such as red meat therein.

A plurality of strand means 7 are provided between the base 1 and the lid 3. In the embodiment shown there are three strand means 7 although the number used can be determined to some extent by the aesthetics of the finished package. The strand means is preferably of polyethylene of a diameter of about 1 mm. A typical size range for the strand means in the embodiment of FIG. 1 may be from 0.05 mm to 5 mm. As can be seen, each of the strand means 7 in the embodiment of FIG. 1 comprises individual filaments.

Figure 2:
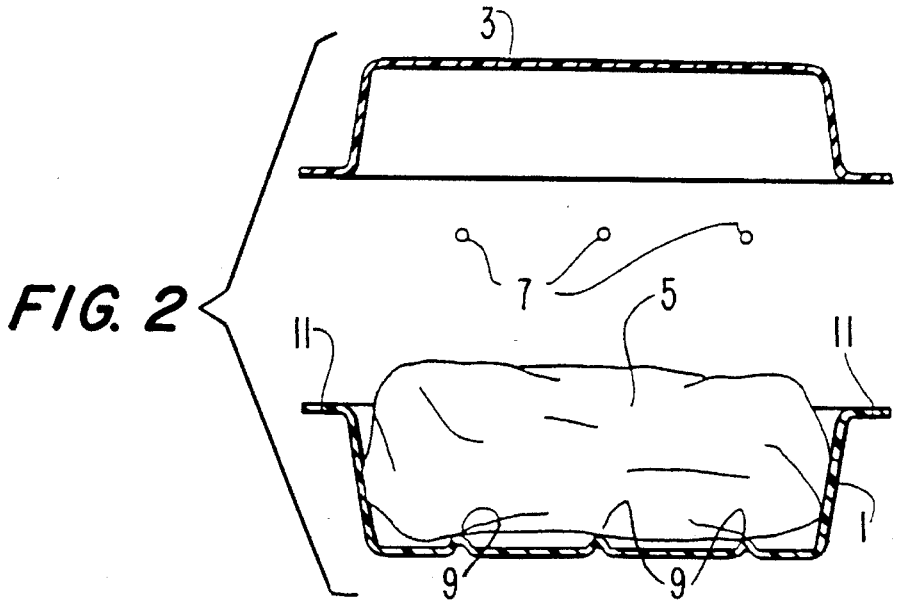
FIG. 2 is an end sectional view of the packaging shown in FIG. 1.

FIG. 2 shows the arrangement in end cross-section. It also shows that the base 1 has a plurality of upstanding ribs 9 which space the bottom of the goods 5 above the bottom of the base 1.

FIG. 3 shows the arrangement just prior to sealing closed the base 1 relative to the lid 3. Here it can be seen that the strand means 7 engage the upper surface of the goods 5 as the goods 5 stand somewhat above the upper surface of the base 1 and in particular, a lip 11 thereof. The strand means 7 are tensioned over the goods 5 so they deform the upper surface of the goods 5 slightly by partly embedding into the upper surface. The strand means 7 are sealed to the base 1 under such tension to firmly hold the goods to the base 1.

A gas for enhancing the keeping qualities of the packaged goods is provided between the base 1 and the lid 3 and is retained within the packaging when the lid 3 and strand means 7 are sealed relative to the base 1. Typically the sealing can be by heat sealing although it may be by gluing or by other means known in the packaging arts such as RF or sonic bonding. The gas which is provided in the packaging for red meats is typically 80% $O_2$ and 20% $CO_2$. It is noted that there is a space 13 provided above the goods 5 and under the lid 3. The volume of the gas retained within the packaging is substantially equal to the volume of the meat or goods 5. Thus, the volume of gas will be sufficient to permit a shelf life of at least several days. Typically, the base 1 and the lid 3 are made of a clear plastics PVC and the coating of polyethylene is also clear. Accordingly, a purchaser will be able to view the goods 5 by looking through the packaging. The strand means 7 is of a size which does not substantially inhibit said gas from contacting the goods. It is also of a size and spacing to permit viewing of a major portion of the upper surface of the goods.

If desired, the base 1 may be made of a non-transparent material. Thus, juices which may exude from the packaged goods 5 may be above to settle on the bottom of the base 1 and not be observed by an intending purchaser because of the opaque nature of the material from which the base 1 is made. A paper or like pad may be used under the meat to soak up any such juices.

The strand means 7 is sufficient to hold the goods 5 within the base 1 so that it does not flop around if the package is inverted or otherwise moved. The strand means 7 is particularly preferred to be stretched under tension across the goods 5 prior to sealing of the lid 3 relative to the base 1. Thus, when the lid 3 is sealed relative to the base 1, the strand means 7 will be sealed and secured relative to the packaging and will always act to hold the goods 5 relative to the packaging without flopping.

The packaging described above has the base 1 and the lid 3 of a material which substantially inhibits the gas within the package from escaping and also substantially inhibits other gases from entering the packaging. The polyethylene coating on the inner faces of the base 1 and the lid 3 provides a convenient means to effect heat sealing of the lid 3 relative to the base 5 and to hold the strand means 7 sealingly retained relative to the packaging.

FIG. 4 shows a different version of strand means which comprises a web of netting like material. Each of the strands in the strand means 7 can be of the same size as previously described for the embodiment of FIGS. 1 through 3, and the mesh size can be in the range of 5 $mm^2$ to 40 $mm^2$.

Figure 5:
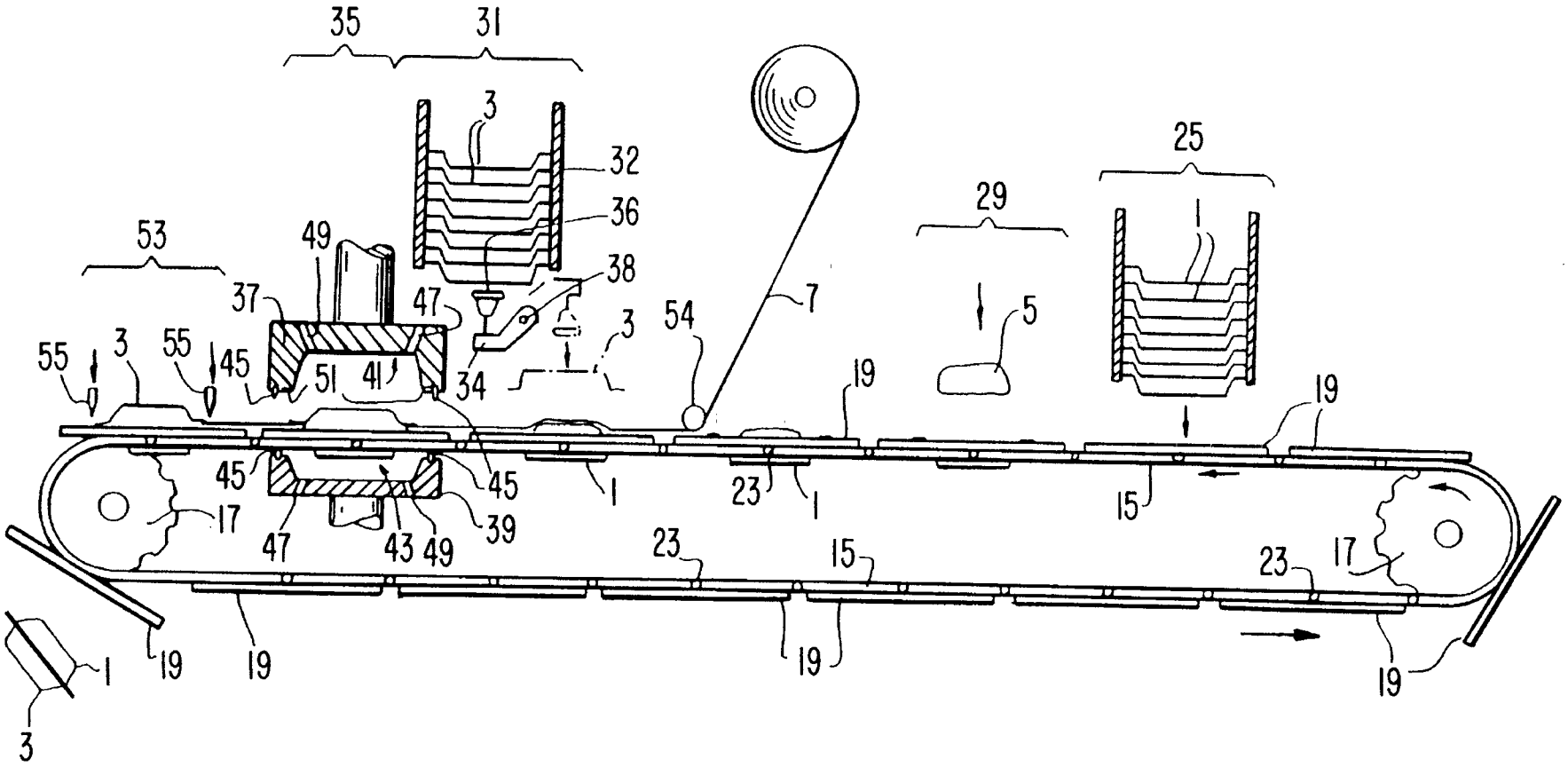
FIG. 5 is a side view of a typical packaging machine for producing packages shown in accordance with the embodiments of FIGS. 1 through 3.

Referring now to FIG. 5 there is shown a particularly preferred embodiment of packaging machine for producing the packaging shown in the embodiments of FIGS. 1 through 3 with the strand means described therefor or as depicted in FIG. 4. Here the apparatus comprises a pair of spaced conveyor chains 15 which pass over driven sprocket wheels 17. Each of the chains 15 supports a respective side of a plurality of plate means 19 which are pivotally supported relative to the chains 15 by brackets means 21 and pins 23. This is more clearly shown in FIG. 6. Each of the plate means 19 is mounted relative to the chains 15 so that the plate means 19 are almost in abutting end-to-end relationship as shown. The sprocket wheels 17 are indexed in their angular rotation so that the plate means 19 index to various work stations along the apparatus.

A first work station 25 comprises a tray 1 loading station where trays 1 are located into an aperture 27 therefor in the plate means 19. Two such apertures 27 are shown in each plate means 19. The apertures 27 are of a size to receive the lowermost portion of the base 1, so that the lip 11 supports the base 1 from the upper surface of the plate means 19. Two such apertures 27 have been shown, representing a preferred arrangement where two packages are produced simultaneously. Other numbers of apertures 27 may be provided so that desired numbers of packages can be produced simultaneously by the apparatus.

The plate means 19 index to a second work station 29 where goods 5 are loaded into the trays 1.

The plate means 19 then next index to a third work station 31 where lids 3 are placed over the top of the goods 5 in the trays 1. The lids 3 are stacked in a holding column 32 in upside down relationship relative to the base 1. An arm 34 carrying pneumatically operated suction cups 36 swings about pivot 38 so the cups 36 engage with the lowermost lid 3 in the column 32. Suction is applied so the lowermost lid 3 is then held by the suction cups 36. The arm then swings to the position shown in dotted line inverting the lids 3, and suction is released. Thus, the lids 3 fall onto the plate means 19 directly over the bases 1 and in the correct inverted relationship thereto. FIG. 6 shows how there are a plurality of upstanding pins 33 on the upper surface of the plate means 19. The pins 33 are spring biased to extend upwardly as shown. Each of the pins 3 around each of the respective apertures 27 aligns the lids 3 relative to the bases 1 carried by the plate means 19 as the lids 33 fall from the suction cups 36.

The plate means 19 then index to a fourth work station 35 where gas flushing and sealing of the lids 3 to the base 1 is effected. The fourth work station 35 has an upper platen 37 and a lower platen 39 with respective chambers 41 and 43 therein. The platens 37 and 39 can be moved by suitable means such as by air bags which are inflated or deflated. The platens 37 and 39 are shown spaced apart as the relevant plate means 19 index into the fourth work station 35. The platens 37 and 39 are then moved to seal on the upper surface and under surface of the plate means 19 respectively. Thus, the chambers 41 and 43 seal relative to the plate means 19. Suitable "O" rings seal means 45 are provided on the outer edges of the upper platen and lower platen 39 to effect such sealing.

When the upper platen 37 and lower platen 39 are sealed relative to the plate means 19, air can be evacuated through air evacuation passageways 47, and a suitable gas for enhancing the keeping properties of the goods 5 can be admitted through gas inlet passageways 49. Thus, each of the chambers 41 and 43 has air removed therefrom and a desired gas introduced thereto. This, in turn, means that air underneath the lid 3 and in the base 1 is exhausted and replaced with the desired gas.

Impulse heat sealing means 51 is provided on the undersurface of the upper plate 37. The impulse heat sealing means 51 may conveniently comprise a known electrical heating strip of flat stainless steel held to the undersurface of the platen 37. An electric current can be supplied to the strip to cause it to heat to, in turn, cause heating of the plastics material around the lip 11 of the base and the corresponding portion of the lip on the lid 3. It will also cause heating of the strand means 7. Thus, because the platens 37 and 39 are applied with pressure against the respective upper and lower faces of the plate means 19, the lid 3 will be forced towards the base 1 around the lip portions at least and will then cause sealing of the lid 3 to the base 1 with the strand means 7 stretched across the goods 5 and held relative to the packaging.

It can be seen that the strand means 7 is fed from a suitable roll to the upper surface of the bases 1 prior to the lids 3 being applied over the bases 1. A suitable tension can be applied to the stand means 7 to cause it to be sealed under tension relative to the packaging thus causing the goods 5 to be tightly held relative to the packaging in the base 1.

The strand means 7 may comprise individual filaments as shown in the embodiment of FIGS. 1 through 3 or it may comprise mesh as shown in FIG. 4.

The sealed packages then index from the fourth work station to a fifth work stations 53 where a pair of guillotines 55 will sever the strand means 7 which interconnects each of the packages passing from the fourth work station 35. As the packages index to the fifth work station 53 they draw the strand means 7 over the package in work station 31. The roll of strand means 7 is controlled so that a required tension is imparted to the strand means 7. A guide roller 54 engages the strand means 7 directly over the top of the goods 5 at work station 31.

As the relevant plate means 19 move over the end sprocket wheel 17 at the left-hand side of FIG. 5, the completed sealed packaged can fall therefrom as by gravity.

Suitable electrical and mechanical control means are used to index the plate means 19 to the relevant work stations and to cause operation of the various loadings and operations at the relevant work stations. These are all considered known in the packaging arts and have not be detailed herein. It should be noted that as the upper platen 37 and the lower platen 39 close on the plate means 19 at the fourth work station 35, the pins 33 will be depressed by the undersurface of the upper platen 37 engaging therewith. The lids 3 will, however, be located relative to the bases 1 at this point of time and thus there will be no expected movement of the lids 3 relative to the base which would cause misalignment of the lid 3 relative to the base 1.

In the embodiment shown herein, the first work station 25 may be replaced by a sheet extruder which extrudes the desired plastic material to a thermoforming station which directly feeds bases 1 in continuous strip-like form into the relevant apertures 27 in the plate means 19. Similarly, a further extruder and thermoformer may be used to provide lids 3 at the third work station 31. The embodiment shown herein represents a very economical machine or apparatus for producing packaging according to the present invention. By using the extruders and thermoformers as suggested above, more sophisticated apparatus can be developed to assist throughput. All this is considered within the skills of the packaging arts and therefore has not been disclosed in detail herein.

Referring now to FIGS. *7a* and *7b*, there is shown a web of plastics material 57 which is used to provide for strand means 7. Here the web is of the required thickness and of the required material. It is first slitted in a series of rows as shown by numerals 59. The web 57 is then elongated both longitudinally and transversely or in only one direction if required, so that the web 57 assumes an expanded mesh arrangement as shown in FIG. *7b*. Thus, the portions of material 61 which remain between the openings 63 provide strand means which will engage with the goods 5. In this embodiment the web 57 may be of a suitable transparent material but desirably the dimensions of the strand means 61 are such that they will not substantially inhibit a person observing the upper surface of the goods 5 or will act to inhibit the gas within the packaging from contacting the goods. In the embodiments shown herein the web 57 may be made from a polyethylene sheet.

The strand means depicted in the embodiments of 7*a* and 7*b* can be used to replace the strand means previously described and may also be incorporated into the apparatus shown in FIG. 5 so that packaging with strand means of this type will be produced.

Figure 10:
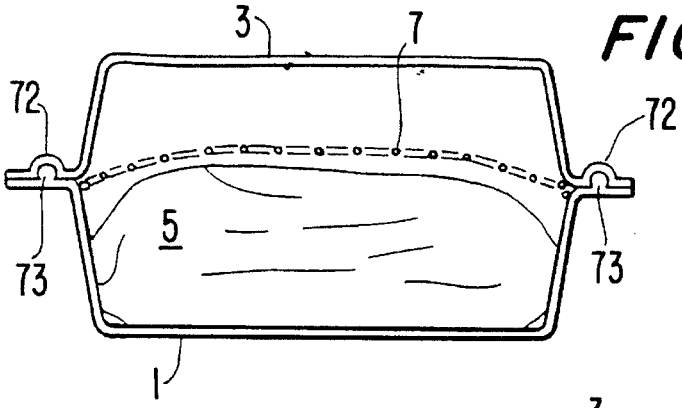
FIG. 10 is a side view of an even further embodiment of packaging.

FIGS. 8 through 10 show further embodiments of packaging within the scope of the present invention, which can be produced by suitably modifying the apparatus shown in FIG. 5.

FIG. 8 shows an embodiment where the goods 5 are totally suspended within the packaging within a mesh bag 65. The bag 65 is stretched and held relative to the packaging by being sealed between the lid 3 and the base 1 as shown. The bag 65 may have mesh of the same size as that previously disclosed in FIG. 4. The bag may not be a bag as such, but may be two separate webs of mesh material which are brought together as the lid 3 is closed relative to the base 1 so that the goods 5 are enclosed within a bag-like mesh. In the embodiment of FIG. 8 it can be seen that there is a space 67 above the goods 5 and a further space 69 below the goods 5. The gas, which is in the package, can freely circulate between spaces 67 and 69 through the mesh and can also contact the surfaces of the goods 5.

FIG. 9 shows a different embodiment where a mesh web of the same type as that shown in FIG. 4 is used, but here the mesh web is brought dow and sealed to the bottom of the base 1 at positions 71 by a suitable heat sealing member or other sealing member (not shown). In this way, the mesh tightly holds the goods 5 relative to the bottom of the base 1 and inhibits flopping around the goods 5 within the packaging.

FIG. 10 shows an embodiment similar to that of FIGS. 1 through 3 but instead of the lid 3 being heat sealed relative to the base 1, it is sealed by having continuous extending snap engaging means 71 and 73 on the lid 3 and the base 1 respectively which co-operate to permit the lid 3 to be snap-lock engaged with the base 1 and to effect a gas tight seal therewith. A web of mesh material of the type disclosed in FIG. 4 can be provided over the goods 5 to provide the strand means 7 to hold the goods 5 relative to the base 1. In this embodiment, the impulse heat sealing means which seals the lid 3 relative to the base 1 can be dispensed with, although it may be preferable to effect heat sealing of the lid 3 to the base 1 to prevent unauthorised tampering of the packaging which may otherwise go undetected by an intending purchaser.

Figure 11A:
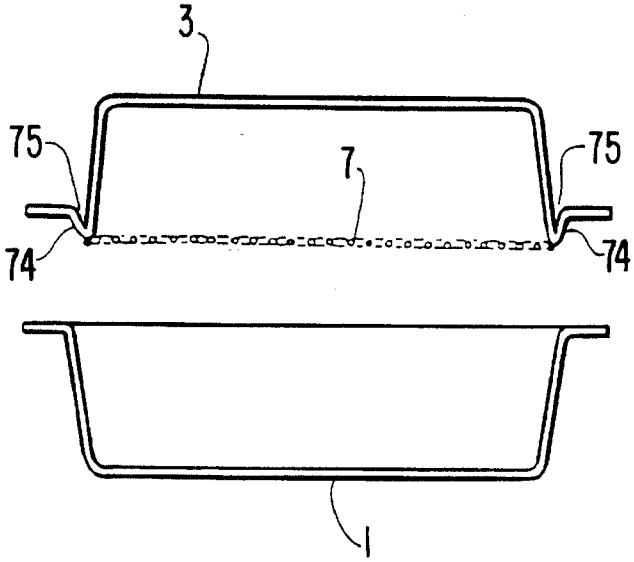
FIGS. 11*a* and 11*b* show side views of a further embodiment of packaging where strand means are integrally attached to a lid prior to closing and sealing of the lid relative to the base.
Figure 11B:
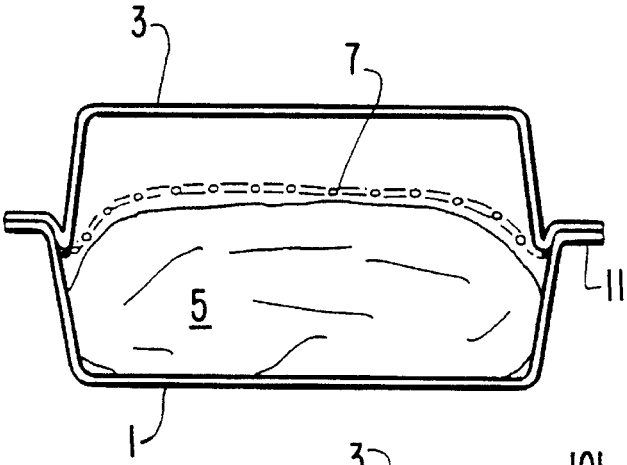

Referring now to the embodiment of FIGS. 11*a* and 11*b*, there is shown packaging where there is provided a base 1 of the type previously disclosed and a lid 3 of the type previously disclosed but wherein the lid 3 has a downwardly extending circumferential rib 74 to which may be bonded a web of mesh material having the configuration as shown in FIG. 4. Thus, a plurality of strand means 7 are provided across the lid 3 from the rib 74. The web may be bonded at positions 75 so that it is carried integrally with the lid 3. In this embodiment the goods 5 may be placed somewhat below the lip 11 on the base 1 and the dimensioning of the rib 74 is such that the strand means 7 are caused to still stretchingly engage with the upper surface of the goods 5 to hold the goods 5 relative to the packaging. This is shown in FIG. 11*b* where the lid 3 has been closed relative to the base 1. In this way any tendency of the goods 5 to spread during closing so that they overlie or contaminate the upper surface of the lip 11 where bonding is to occur and subsequent sealing is to be effected, is reduced.

Figure 12:
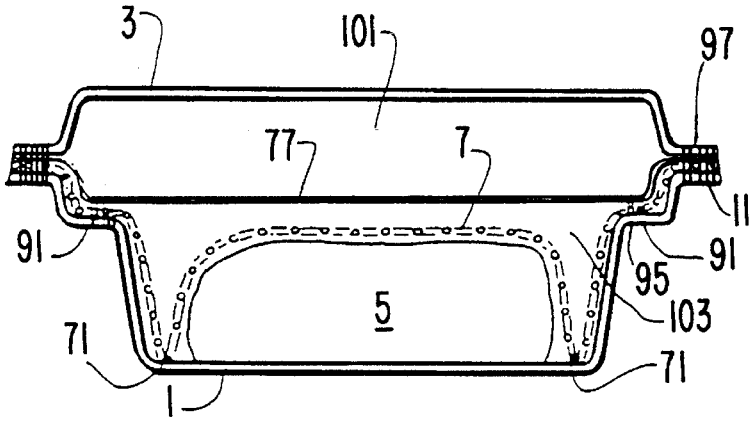
FIG. 12 is a side view of an even further embodiment.

Referring now to FIG. 12 there is shown a further embodiment which is similar to the embodiment shown in FIG. 9. Here the base 1 has the upper peripheral lip 11 plus an intermediate peripheral lip 91. The strand means 7 extends from the upper lip 11 down the inside faces of the base 1 to the intermediate lip 11, down to the bottom of the base 1 and over the upper surface of the meat 5. The strand means is secured to the bottom of the base 1 at positions 71 to hold the meat to the base 1 to inhibit flopping around within the packaging. An inner web 77 of gas permeable clear plastics material can then extend from the upper peripheral lip 11, down the inside face of the base 1 to the intermediate peripheral lip 91. Typically the web 77 can be held at the upper peripheral lip 11 and stretched downwardly to intermediate lip 91 so it will be stretched taut across the base 1 over the meat 5 and secured to the intermediate lip 91. Typically the web 77 can be of LDPE and have a thickness range of from 10 microns to 1,000 microns. Other plastics and thicknesses are possible but the above represents an economical choice. The web 77 is preferably of a gas permeable material although it may be a non-gas permeable material with passageways, i.e. openings therein to allow gas to pass.

The lid 3 is bonded to the base 1 over the web 77, around the upper peripheral lip 11 at positions 97 so that the lid is sealed gas tight relative to the base 1. A desired gas is provided within the package prior to sealing the lid 3 to the base 1. Thus, the desired gas will occupy a first space 101 between the lid 3 and the web 77. The desired gas may also occupy the second space 103 between web 77 and the base 1. The volume of the desired gas is such that it will permit enhanced keeping of the meat 5 for at least several days. Thus, the volume can be substantially equal to the volume of the meat 5. Because the web 77 is gas permeable or can allow gas to pass through openings therein, the total volume of gas in the packaging will be available for enhancing the keeping of the meat 5.

The bonding at positions 97 to secure the lid 3 to the base 1 is preferably releasable as by peeling so that the lid 3 can be removed from the base 1 without disturbing the bonding of web 77 or strands 7 to the base 1. Thus, should the meat 5 discolor with time—i.e. turn dark brown with time—the lid 3 can be removed to allow oxygen in the atmosphere to then permeate through the web 77 or pass through the openings therein to contact the meat 5 and to bloom it to a bright red color. Thus, the packaging is still sealed and the meat 5 still hygenically packaged even though the lid 3 has been removed. Accordingly, a store or shop or purchaser is able to remove the lid 3 if the meat turns dark brown so as to bloom the meat 5 to a bright red colour while still leaving the meat 5 hygenically packed. If the web 77 is without openings then desired the gas in space 101 may be chosen to be different to the gas in space 103. This may be useful where it is desired to retain the meat 5 in one gas environment for an initial time and then subject the meat 5 to a different gas environment for the remaining time. Thus, the gas permeability of web 77 can be chosen so that the gas in space 101 will permeate to space 103 to a required amount after the initial time.

The surfaces of web 77 may be coated with required plastics or adhesives to permit bonding at positions 95 and 97 so the base 1 and lid 3 will be sealed and integrally attached to one another. Typically positions 95 and 97 are continuous peripheral seals caused by heat bonding.

Because the web 77 is stretched taut above the meat 5—i.e., it does not touch the upper surface of meat 5—it will appear as a substantially invisable web whilst lid 3 remains attached to base 1.

The plastics material for the packaging components described herein is preferable and may be replaced with other packaging materials if desired. The materials described in the preferred embodiment herein represent an economic material at this point of time.

If desired the base 1 and lid 3 may be a linear low density polyethylene web such of the type used for wrapping pallets in a shrink wrapping. Each web of plastics may have a partial gas barrier coating on the inside face of the packaging to inhibit escape or introduction of gases. The nature of the polyethylene is such that it has a natural shrinkage which will offset to some degree of the amount of absorption of the gas into the goods 5, and not cause the package and in particular the lid 3, to bow inwardly as the gas is absorbed.

Instead of sealing the strand means to the base at the time of sealing the lid to the base, the strand means may be sealed to the base at a strand sealing station and then the base and the strands passed to a lid sealing station where the lid can be sealed to the base with a desired gas sealed between the lid and the base to enhance the keeping properties of the packaged goods such as red meats.

Modifications may be made to the invention as would be apparent to persons skilled in the packaging arts.

These and other modifications may be made without departing from the ambit of the invention, the nature of which is to be determined for the foregoing description.

I claim:

1. Improved packaging for perishable goods comprising:

a base over which said goods are placed, strand means over said goods holding said goods relative to said packaging, a lid positioned over the top of said base and sealed to said base, a space above said goods and under said lid, a gas in said space, said gas selected for enhancing preservation of the packaging goods by contacting the surface of said goods, said gas contacting said goods by passing said strand means and said strand means being of a size permitting viewing of a major portion of an upper surface of said goods.

2. Packaging as claimed in claim 1 wherein said strand means is stretched over said goods and held to said packaging so said strand means is maintained stretched to firmly hold said goods to the packaging.

3. Packaging as claimed in claim 2 wherein said base is of a tray like configuration with a bottom displaced in height from a peripheral lip, and wherein said goods are contacting the bottom, and the upper surface of said goods is above the upper surface of said lip, and said strand means extends over the top of said goods and is held to the peripheral lip.

4. Packaging as claimed in claim 2 wherein said base has a bottom displaced in height from a peripheral lip and wherein said goods are contacting said bottom, and said strand means are held to said packaging at a position below the top of said goods.

5. Packaging as claimed in claim 4 wherein said strand means are held to the bottom of said base.

6. Packaging as claimed in claim 4 wherein said lid is of tray like configuration with a top displaced in height from a peripheral lip and wherein said strand means is integrally held to said lid across said peripheral lip, and wherein when said lid is closed over said base and sealed to said base said strand means is tensioned by engaging with said goods.

7. Packaging as claimed in claim 6 wherein said lid has a rib means at said peripheral lip the bottom of which is displaced in height a greater distance from said top than said peripheral lip and wherein said strand means is connected to said rib means.

8. Packaging as claimed in claim 4 wherein the top of said goods is below said peripheral lip and there is provided a web of plastics material sealed to said lid with a space between said web of plastics material and said lid with a desired gas in said space which can either permeate said web of plastics material or pass through apertures therein to enhance the keeping of said goods.

9. Packaging as claimed in claim 4 wherein the top of said goods is below said peripheral lip and there is provided a web of gas permeable plastics material sealed to said lid with a space between said lid and said web and a gas in said space for enhancing keeping of said goods by permeating said web and wherein said lid is independently removable from said packaging leaving said web sealed to said packaging whereby oxygen can permeate said web from atmosphere to bloom said goods to a red colour following discolouring of said goods from extended packaging.

10. Packaging as claimed in claim 1 wherein said lid and said base are substantially gas impervious gas barrier material.

11. Packaging as claimed in claim 1 wherein said goods are suspended between said base and said lid by said strand means so said goods are not touching either said lid or said base.

12. A method of packaging perishable goods in packaging so said goods will be a gas environment which will enhance the keeping properties of said goods said method comprising providing a base, placing goods over said base, applying strand means over said goods, applying a lid over said base over said strand means providing a desired gas between said lid and said base which will enhance the keeping properties of said goods by contacting the surface of said goods and sealing said lid to said base with said gas therebetween, said strands means then holding said goods relative to said packaging and being of a size permitting viewing of a major portion of an upper surface of said goods and allowing said gas to contact said goods by passing said strand means.

13. A method as claimed in claim 12 wherein said strand means is stretched over said goods and held to said packaging so said strand means is maintained stretched to firmly hold said goods to the packaging.

14. Apparatus for packaging perishable goods in a gas environment to enhance the keeping properties of said goods comprising means for holding a packaged base with said goods over said base, means for applying strand means over said goods over said base, means for applying a lid over said base, means for bringing said base, said strand means and said lid together with a desired gas therebetween said gas being for enhancing the keeping properties of said goods by contacting the surface of said goods, and means for sealing said lid to said base with said strand means and with said gas therebetween whereby said strand means will hold said goods to said packaging, said gas contacting said goods by passing said strand means and said strand means being of a size permitting viewing of a major portion of an upper surface of said goods.

15. An apparatus as claimed in claim 14 wherein said base has a bottom displaced in height from a peripheral lip and wherein said means for holding a packaging base comprises a plate with an aperture therein so said bottom passes into said aperture and said peripheral lip rests on the upper surface of said plate around the perimeter of said aperture, and wherein said means for bringing said base said strand means and said lid together with a desired gas therebetween comprises a platen for sealingly engaging with the undersurface of said plate around said aperture, and a further platen for sealing said lid and said strand means to said peripheral lip with said desired gas between said lid and said base.

16. A method of packaging goods, said method having the following steps:

(a) providing three overlapping webs, the two outer webs being gas barrier webs and the inner web being a gas permeable web;

(b) providing goods between a gas barrier web and said gas permeable web;

(c) sealing gas flushing chamber means closed about the three webs and the goods prior to any of the three webs being sealed together at a seal path near a perimeter of the packaging;

(d) gas flushing the gas flushing chamber means with a gas to enhance the keeping of the goods; and (e) then sealing the three webs together by a sealing means which defines a seal path near what will be a perimeter of the packaging and which extends completely around said seal path, said sealing being of all three webs around said seal path and in said gas flushing chamber means to define a substantially gas impermeable package with said goods and said gas both sealed therein, and allowing said gas to contact said goods.

17. A method as claimed in claim 16, wherein said goods are meats and said gas is typically 80% $O_2$ and 20% $CO_2$.

18. A method as claimed in claim 16, wherein the volume of said gas in the package is substantially equal to the volume of meat in the package.

19. A method as claimed in claim 16, wherein the remaining gas barrier web is of tray-like configuration with a bottom displaced in height from a peripheral lip and wherein said sealing path is effected on said peripheral lip.

20. A method as claimed in claim 16, comprising stretching said gas permeable web taut prior to said sealing so said gas permeable web remains taut within said packaging.

21. A method as claimed in claim 16, wherein said gas permeable web has openings therein and allowing said gas to pass through said openings.

22. A method as claimed in claim 16, comprising providing strand means between said gas permeable web and said goods and sealing said strand means to hold said goods to the gas barrier web.

23. A method as claimed in claim 19, wherein said remaining gas barrier web has an intermediate lip and sealing said gas permeable web to said intermediate lip so there is a space between said gas permeable web and said one of the gas barrier webs, and said gas is also in said space.

24. A method as claimed in claim 19, comprising selecting the height from said bottom to said lip of said remaining gas barrier web to be higher than the height of said goods, and effecting sealing so said gas permeable web is not contacting the upper surface of said goods when said goods are on said remaining gas barrier web.

25. A method as claimed in claim 16, wherein said gas flushing chamber means is evacuated of atmospheric gas prior to said gas flushing.

26. A goods package, said package having two gas barrier webs and an intermediate gas permeable web, goods between a gas barrier web and said gas permeable web, said webs being sealed together by a seal extending completely around and near the perimeter of the packaging, a gas sealed in a gas barrier manner in the packaging and contacting said goods, said gas selected for enhancing the keeping of said goods, and wherein the gas barrier web and said gas permeable web that said goods are between is of tray-like configuration with a bottom displaced in height from a peripheral lip, said seal being on said peripheral lip and wherein said height is greater than the height of said goods so when said goods are resting on said gas barrier web said gas permeable web is not touching said goods.

27. A goods package as claimed in claim 26, wherein said gas permeable web has openings therein to allow said gas to pass through said openings.

28. A goods package as claimed in claim 26, wherein said gas permeable web is stretched and said package is sealed with it stretched so it remains taut over said bottom.

29. A goods package as claimed in claim 26, wherein said gas is typically 80% $O_2$ and 20% $CO_2$.

30. A goods package as claimed in claim 26, wherein the volume of said gas in said package substantially equals the volume of meat in said package.

31. Apparatus for packaging perishable goods in a gas environment to enhance the keeping of said goods, comprising a gas flushing and sealing chamber means for holding a first web of a gas barrier material with said goods over said first web, and characterized by means for feeding an intermediate web of gas permeable material over said first web, and means for applying a further web of gas barrier material over said first web, said gas flushing and sealing chamber being closeable to bring all three webs together prior to any of those webs being sealed together at a seal path near a perimeter of the packaging, and means for introducing a gas to enhance the keeping of said goods into said gas flushing and sealing chamber, and sealing means in said gas flushing and sealing chamber for then sealing all three webs together in said gas flushing and sealing chamber with said gas sealed in the resulting package.

32. Apparatus for packaging perishable goods as claimed in claim 31, characterized that said first web has a bottom displaced in height from a peripheral lip and wherein said means for holding said first web comprises a plate with an aperture therein so said bottom passes into said aperture and said peripheral lip rests on the upper surface of said plate around the perimeter of said aperture, and wherein said gas flushing and sealing chamber closes over the top and bottom of said plate when said gas flushing and sealing chamber is sealed, evacuated, and gas flushed, and said three webs are sealed with said gas sealed in the resulting package.

* * * * *